United States Patent [19]

Reuland

[11] 3,991,605

[45] Nov. 16, 1976

[54] METHOD AND APPARATUS FOR TESTING THE WRAPPERS OF CIGARETTES AND THE LIKE

[75] Inventor: Joachim Reuland, Hamburg, Germany

[73] Assignee: Hauni-Werke Korber & Co. KG, Hamburg, Germany

[22] Filed: July 17, 1975

[21] Appl. No.: 596,904

[30] Foreign Application Priority Data

July 19, 1974 Germany ..... 2434736

[52] U.S. Cl. ..... 73/38; 73/45.2; 209/72

[51] Int. Cl.[2] ..... G01M 3/26

[58] Field of Search ..... 209/73, 74 R, 74 M, 209/111.7 T, 111.6, 72, 71; 73/37, 37.6, 38, 45.1, 45.2

[56] References Cited

UNITED STATES PATENTS

| | | | |
|---|---|---|---|
| 3,416,658 | 12/1968 | Goller et al. | 209/74 R X |
| 3,533,279 | 10/1970 | Snow et al. | 73/45.1 |
| 3,690,149 | 9/1972 | Pezzi | 73/45.2 X |
| 3,708,064 | 1/1973 | Schepler et al. | 209/73 |
| 3,720,311 | 3/1973 | Harrison | 73/37.6 X |
| 3,779,378 | 12/1973 | Scherf | 209/73 |

*Primary Examiner*—Robert B. Reeves
*Assistant Examiner*—Joseph J. Rolla
*Attorney, Agent, or Firm*—Peter K. Kontler; John Kurucz

[57] ABSTRACT

A first signal is generated indicative of the gas permeability of the wrapper of the article being tested. A second signal is generated indicative of the porosity of the material of the wrappers of the articles being tested. The first and second signals are processed to form for each article a third signal indicative, to an extent greater than the respective first signal, of the component of the gas permeability of the article not attributable to the porosity of the material of the wrapper. The third signal is compared to a reference signal to determine whether the wrapper of the tested article is defective. The aforementioned second signal is generated by averaging out the gas permeabilities of the wrappers of a number of such articles. In order to generate a second signal not influenced by the marked gas permeability variations encountered when testing defective cigarettes, the gas permeabilities of the wrappers of defective cigarettes are positively excluded from the averaging out involved in the generation of the aforementioned second signal.

25 Claims, 1 Drawing Figure

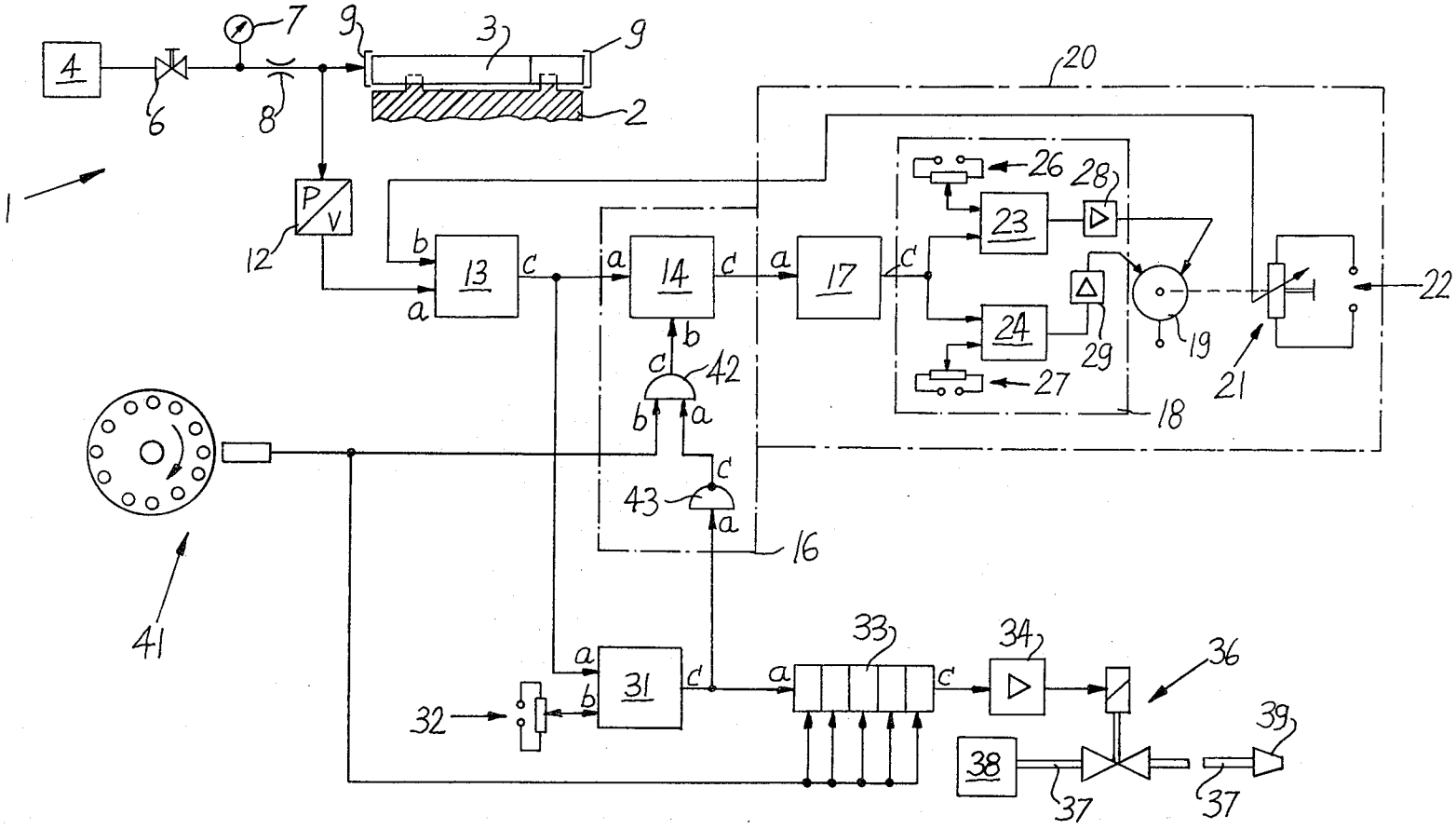
1
2
3
4
6
7
8
9
9
12
13
14
16
17
18
19
20
21
22
23
24
26
27
28
29
31
32
33
34
36
37
37
38
39
41
42
43

METHOD AND APPARATUS FOR TESTING THE WRAPPERS OF CIGARETTES AND THE LIKE

BACKGROUND OF THE INVENTION

The invention relates to methods and apparatus for testing the wrappers of cigarettes, cigars, cigarillos, cigarette filters, other rod-shaped smokers' articles, and the like.

More specifically, the invention relates to methods and apparatus for such purpose of the type in which there are generated a first signal indicative of the air permeability of the wrapper of the article, a second signal indicative of the porosity of the material of the wrappers of the articles, and a third signal derived from the first and second signals and indicative of that component of the air permeability of the wrapper of the article not attributable to the porosity of the wrapper material itself.

In the cigarette-manufacturing industry, it is known to test the wrappers of cigarettes, cigars, cigarillos, cigarette filters, filter cigarettes, other rod-shaped smokers' articles, and the like. The testing of the wrappers is intended to detect the presence of holes in the wrapper paper, imperfectly formed seams in the wrapper, defective joints between the tobacco-containing section of a filter cigarette and the filter head thereof, and other defects which could detrimentally affect the smoking experience by causing a significant inflow of adjoining air through the defective wrapper when the smoker inhales through the cigarette, or the like.

For example, it is known to assess the integrity of a cigarette wrapper by sealing off one end of the cigarette and by known means connecting the other end of the cigarette to a source of pressurized air. If there are breaks or seam defects in the wrapper, then a sizable airflow outwards through the wrapper defects will occur. This outwards airflow can be detected by monitoring the air pressure of the air entering the cigarette. For example, if there is a sizable opening in the wrapper seam, permitting a sizable airflow out through this opening, the air pressure upstream of the cigarette will be lowered; conversely, if the integrity of the wrapper is complete, there will be comparatively little airflow out through the wrapper and this can be detected in the form of a comparatively high pressure upstream of the cigarette.

However, an ever-present problem with this and other such wrapper testing methods is constituted by the porosity of the material of the wrapper. Because the material of the wrapper may be quite porous, a considerable amount of air may flow outwards through the surface of the material of the wrapper, for example when performing a wrapper test of the type just described. That component of the total air permeability of the wrapper specifically attributable to the porosity of the wrapper material itself in general cannot be distinguished from the component attributable to wrapper defects, and accordingly the generation of a signal indicative of the total air permeability of the wrapper is of only limited usefulness. For example, the total air permeability of a high-porosity wrapper having no defects may be greater than the total air permability of a comparatively low-porosity wrapper having completely unacceptable defects; as a result, it is to an unsatisfactory extent necessary either to discard acceptable articles or not to discard unacceptable articles.

The porosity of the material of the wrappers changes markedly, in particular, from one supply reel to the next. Accordingly, when changing wrapper material supply reels, a large number of articles may be automatically rejected by the testing apparatus before the operating personnel can effect the necessary readjustments and corrections. The loss of so many articles which may in fact be perfectly acceptable is of course undesirable, and the necessity of repeatedly readjusting the testing apparatus is very inconvenient.

West German Published Patent Application No. 2,109,412 discloses an arrangement for automatically adjusting the wrapper testing apparatus in response to fluctuations in the porosity of the material of the wrappers. The porosity of the wrapper material is determined separately from the determination of the total air permeability of the wrapper of the finished article. Specifically, the wrapper material, prior to the actual manufacture of the finished article, is conducted past a suction chamber. The suction in the suction chamber is a direct indication of the porosity of the wrapper material. The suction in the suction chamber is detected and converted into a corresponding control signal. The control signal is then employed to automatically compensate for the porosity of the wrapper material, by automatically adjusting the pressure of the air used to test the wrappers of the finished articles made from the measured wrapping material. This known arrangement is of dubious operability for various practical reasons. It is very difficult to establish a complete enough seal between the wrapper material and the interior of the suction chamber. Additionally, which cannot be seen very clearly from the drawing of the publication in question, the two testing arrangements are located quite far from each other in space. The one is located at the input of the cigarette rod machine whereas the other is located at the output of the filter attachment machine; as a result, before a finished article made from the wrapper material whose porosity has been measured actually reaches the wrapper testing station, fifty to sixty articles may have already passed the wrapper testing station. Accordingly, although an automatic correction is supposedly achieved, it is at best achieved with a very considerable time delay. Moreover, if the wrapper material itself is defective over a considerable length, for example if it is replete with sizable holes and tears, this will be misinterpreted as a more increase of the porosity of the wrapper material, and the pressure of the air used at the wrapper testing station will be correspondingly adjusted. As a result, at the wrapper testing station, the defective finished articles made from the defective wrapper material section will not be detected as being defective.

We have considered the possibility of detecting wrapper material porosity fluctuations using the testing apparatus for the wrappers of the finished articles and, in correspondence to such detection, correcting the results of the wrapper tests. The pressure of the test air used for testing the wrappers of the finished articles would be applied to a pneumatic storage connected to one input of a differential pressure meter to whose other input is applied the test pressure. The pressure in the storage would adjust itself to long-term or persisting changes in the test pressure, whereas short-lasting changes would be registered by the differential pressure meter. A disadvantage of this approach is that, upon start-up of the testing apparatus, the pressure in the pneumatic storage must first build up to an operational value, and this results in the rejection of the first forty to fifty articles. Furthermore, in the event that a series of articles are all defective, the pressure in the pneumatic storage will gradually adjust itself to the pressure associated with the defective articles, with the result that subsequent defective articles will not be detected as being defective.

SUMMARY OF THE INVENTION

It is a general object of the invention to provide a method and apparatus for testing the wrappers of finished cigarettes, cigars, cigarillos, cigarette filters, other rod-shaped smokers' articles, and the like, which take into account fluctuations in the wrapper material porosity without detracting from the accuracy and precision of the testing of the wrappers of the finished articles.

This object, and others which will become more understandable from the description, below, of a preferred embodiment, can be met, according to one advantageous concept of the invention, by generating a first signal indicative of the air permeability of the wrapper of the finished article and a second signal indicative of the porosity of the wrapper material, with the second signal being formed by averaging out a sum of signals derived from a plurality of such first signals, but those of such derived signals which correspond to defective articles being excluded from the averaging operation. The second signal can have a magnitude corresponding to the absolute porosity of the wrapper material, or it can have a magnitude corresponding only to the deviation of the wrapper material porosity from a base value.

According to a preferred concept of the invention, the detection of wrapper material porosity fluctuations is accomplished by processing the first or total-air-permeability signal and the second or wrapper-material-porosity signal to form a third signal, the third signal corresponding, to an extent much greater than the first signal, to that component of the total air permeability of the wrapper not attributable to the wrapper material porosity. Preferably, the second signal is formed by averaging out the values of the third signals corresponding to a plurality of articles all having wrappers which have previously been determined to be non-defective. In order that the wrapper material porosity be taken into account immediately upon a resumption of operation, after an interruption in the feeding of articles having wrappers to be tested, the invention contemplates providing the second signal as a signal having a duration which is independent of the manner of its generation; for example, the second signal can be a persisting signal. The inventive expedients are particularly well adapted for use with wrapper testing procedures of the type wherein the wrappers are tested by pneumatic means, with the resulting pneumatic measurement signal being converted into an electrical measurement signal.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE depicts schematically one embodiment of the invention.

DESCRIPTION OF THE PREFERRED EMBODIMENTS

A pneumatic testing apparatus 1 tests the wrappers of rod-shaped articles 3 travelling on a conveyor 2, for example a testing or transfer drum. The rod-shaped articles may be cigarettes, cigars, cigarillos, cigarette filters, other rod-shaped smokers' aricles, components thereof, or the like. In the illustrated exemplary embodiment, the rod-shaped articles 3 are filter cigarettes.

The pneumatic testing apparatus 1 is comprised of a source 4 of pressurized air, an adjustable valve 6, a manometer 7, a flow restrictor 8 and sealing means 9. The sealing means 9, schematically depicted, serves in per se known manner to seal off the ends of the filter cigarette 3 and to admit pressurized air from the source 4 into the interior of the filter cigarette 3. The pressurized air admitted into the interior of the cigarette can escape through the whole surface of the porous wrapper material itself and also through defective portions of the wrapper, such as perforations or tears in the wrapper, openings in the wrapper seam, an imperfect joint between the tobacco-containing section of the filter cigarette and the filter head, etc. Depending upon the porosity of the wrapper material, and depending upon the presence of defects of the type just mentioned, a greater or lesser amount of the air introduced into the interior of the cigarette 3 will escape to the outside. This escape of air make itself apparent in the form of a partial loss of pressure downstream of the flow restrictor 9. By detecting the air pressure at this point, one indirectly determines the total air permeability of the wrapper of the filter cigarette 3.

To detect this pressure, use is made of a pressure-to-voltage transducer 12 (for example a membrane capsule whose membrane positions the wiper of a potentiometer, or the like). The transducer 12 generates an electrical output signal constituting a first signal indicative of the total air permeability of the wrapper of the filter cigarette 3. Details of such a testing device may be had, inter alia, from German Pat. No. 1,300,458 and from corresponding U.S. Pat. No. 3,412,856.

The magnitude of this first or total-air-permability signal at the output of transducer 12 is inversely related to the air permeability of the wrapper, and accordingly inversely related to the porosity of the wrapper material. The greater the air permeability of the wrapper in general, or the greater the porosity of the wrapper material in particular, the smaller is the magnitude of this first signal, and vice versa.

The output of the pressure-to-voltage transducer 12 is connected to input *a* of a signal processing stage 13. In this exemplary embodiment, the signal processing stage has the form of a simple difference amplifier 13 operative for generating at its output *c* a third signal having a magnitude equal to the magnitude of the first signal (applied to input *a*) minus the magnitude of a second signal (applied to input *b*).

The output *a of* of difference amplifier 13 is connected to input of a sample-and-hold circuit 14. The sample-and-hold circuit 14 can be of the type manufactured by the National Semiconductor Corporation under the trade designation LH 0023. The sample-and-hold circuit 14 has an output *c* and a sample-signal input *b*.

The sample-and-hold circuit 14 forms part of a signal transfer circuit 16 operative for controlling the transfer of third signals from the output *c* of difference amplifier 13 to the input a of an averaging circuit 17 described below.

The third signals, from the output *c* of difference amplifier 13, are transferred by signal transfer circuit 16 to the input of a circuit 20 operative for generating a second signal theoretically indicative of the porosity of the wrapper material of the filter cigarettes 3. The manner in which this second signal is generated will be described in detail below. It should be noted immediately, however, that this second or wrapper-material-porosity signal is applied by circuit 20 to the inverting input *b* of difference amplifier 13. Accordingly, the difference amplifier 13 receives two input signals: the first signal at input *a* indicative of the total air permeability of the wrapper of the filter cigarette 3, and the second signal at input *b* indicative of that component of the total air permeability directly attributable to the wrapper material porosity. Accordingly, the third signal at output *c*, equal in magnitude to the first signal at input *a* minus the second signal at input *b*, will have a magnitude corresponding to that component of the total air permeability of the wrapper not attributable to the wrapper material porosity. In other words, the third signal (at input *c* of difference amplifier 13) will have a value indicative of that component of the total air permeability of the wrappeer attributable to wrapper defects such as breaks in the wrapper material, defective wrapper seams, defective joints between the wrapper of the tobacco-containing section of the cigarette and the wrapper of the filter head, etc. In theory, if the wrapper is not defective, the third signal (at output *c* of difference amplifier 13) should have the value zero. This is because the measured air permeability of the wrapper would be attributable exclusively to the wrapper material porosity itself, and because it is precisely the component of the total air permeability attributable to wrapper material porosity which is in theory eliminated from the first signal (at input *a* of 13) in forming the third signal (at output *c* of 13).

The circuit 20, operative for generating this second or wrapper-material-porosity signal, is comprised of the averaging circuit 17, an evaluating circuit 18, an adjusting motor 19, and a signal generator 21 having the form of a potentiometer connected across a voltage source 22. The averaging circuit 17 can have any of a variety of known circuit configurations; at its simplest, it could consist of an elementary one-resistor, one-capacitor low-pass filter or of an RC-low-pass filter of more complicated configuration. The combination of the adjusting motor 19 and the potentiometer signal generator 21 can for example be the device known in the art under the name "Motor-potentiometer"; this device is for example manufactured as a single component by the Megatron Corporation of Munich, Federal Republic of Germany, and is comprised of a D.C. motor type 15255, a transmission type FMM 15 and a rotary potentiometer type AL 2510.

The input *a* of averaging circuit 17 is connected to output *c* of sample-and-hold circuit 14, whereas its output *c* is connected to the input of evaluating circuit 18. Evaluating circuit 18 is comprised of two comparators 23, 24, for example type LM 311 made by the National Semi-conductor Corporation. The comparators 23 and 24 are so connected that comparator 23 generates an output signal when the output signal of averaging circuit 17 exceeds a certain positive value (e.g., +1V), whereas comparator 24 generates an output signal when the value of the output signal of averaging circuit 17 falls below a certain negative value (e.g., −1V). In the first case, the adjusting motor 19 turns the wiper of the rotary potentiometer 21 in such a direction as to cause the potentiometer output voltage (applied to input *b* of difference amplifier 13) to increase; in the second case, the potentiometer wiper is turned in a direction causing the magnitude of the second signal (applied to input *b* of difference amplifier 13) to decrease.

Adjusting motor 19 adjusts the position of the wiper of the rotary potentiometer 21 relatively slowly; for example, the output shaft of adjusting motor 19 can be coupled to the wiper of rotary potentiometer 21 through the intermediary of a speed-reducing transmission having a very low transmission ratio.

The output *c* of difference amplifier 13 is furthermore connected to input *a* of a comparator 31 whose second input *b* is connected to the wiper of a potentiometer 32 which serves as the generator of a reference signal. This reference signal is indicative of the maximum permissible air permeability of the cigarette wrapper. More precisely, this reference signal is indicative of the maximum value which can be permitted for that component of the total air permeability of the cigarette wrapper not attributable to wrapper material porosity. As already indicated, the third signal (at output *c* of 13) is indicative of that component of the total air permeability not attributable to wrapper material porosity. In the event that the component of air permeability indicated by the third signal (at input *a* of 31) exceeds the permissible value indicated by the reference signal (at input *b* of 31), a defect signal appears at output *c* of comparator 31.

Output *c* of comparator 31 is connected to input *a* of a time-delay shift register 33 whose output *c* is connected to the control solenoid of a solenoid valve 36 through the intermediary of a power amplifier 34. The solenoid valve 36 is connected in a conduit 37 leading from a source 38 of pressurized air to an ejection nozzle 39. The ejection nozzle 39 can, for example, be positioned adjacent the path of travel of cigarettes, at a convenient location downstream of the pneumatic testing station 1. In that event, the number of shift-register stages of shift register 33 will correspond to the distance between the pneumatic testing station 1 and the ejection station at which the ejection nozzle 39 is located. The shift register 33 receives shift signals from a synchronizer 41 which may for example be synchronized with the operation of the drive means which effects travel of the tested cigarettes from the testing station 1 to the ejection station adjoining ejection nozzle 39.

The signal transfer circuit 16 includes, besides the sample-and-hold circuit 14, an AND-gate 42 and a NOT-gate 43. The output *c* of AND-gate 42 is connected to sample-signal input *b* of sample-and-hold circuit 14. Input *a* of AND-gate 42 is connected to output *c* of NOT-gate 43 whose input *a* is connected to output *c* of comparator 31. Input *b* of AND-gate 42 is connected to the output of the synchronizer 41.

The illustrated arrangement operates as follows.

Before the testing apparatus depicted in the FIG. is set into operation, it is necessary to manually set the wiper of potentiometer signal generator 21 to a position such that the magnitude of the second signal (at input *b* of 13) will correspond to the normally prevailing average value of wrapper material porosity. It is to be understood that this manual adjustment is required only the very first time the testing apparatus is set into operation. Thereafter, even if the testing apparatus is shut down for a considerable period of time, no manual readjustment of the position of the potentiometer wiper will be required. The wiper will simply remain in the position which it last had during operation of the testing apparatus, and such last position will correspond to a wrapper material porosity within the normal range of variation.

The conveyor 2 moves one filter cigarette 3 after another into the testing station 1, whereupon the cigarette is sealed and filled with pressurized air. The pressure-to-voltage transducer 12 generates a first electrical signal indicative of the total air permeability of the wrapper of the tested cigarette 3, and applies this first signal to input *a* of difference amplifier 13. As already indicated, there is applied to input *b* of difference amplifier 13 a second signal indicative of the wrapper material porosity or, expressed in other words, indicative of the component of the total air permeability of the wrapper which can be attributed to the wrapper material porosity. Accordingly, the third signal, appearing at output *c* of difference amplifier 13, is indicative of that component of the total air permeability of the wrapper which is not attributable to the wrapper material porosity. In other words, the third signal (at output *c* of 13) is indicative of that component of the total air permability of the wrapper which is attributable to wrapper defects, if any. If there are no wrapper defects whatsoever and if, accordingly, the total air permability of the wrapper is entirely attributable to the wrapper material porosity, then the third signal should in theory be zero.

This third signal (at output *c* of 13) is applied to input *a* of comparator 31. The comparator 31 compares the third signal against the reference signal applied to comparator input *b* by reference potentiometer 32. The comparator 31 determines whether the third signal (at input *a* of 31) has a value lower than that of the reference signal (at input *b* of 31). If this is in fact the case, then the pressure sensed by pressure-to-voltage transducer 12 is too low — i.e., the amount of air escaping outwards from the interior of the cigarette 3 through the wrapper thereof is so large as to indicate that the wrapper is defective. If so, the comparator 31 generates at its output *c* a defect signal, which it applies to the input of shift register 33. As the defective cigarette travels from the pneumatic testing station 1 to the ejection station at which is located ejection nozzle 39, the corresponding defect signal travels from the first to the last shift register stage in simulation of the travel of the associated defective cigarette. When the defective cigarette reaches the ejection nozzle 39, the corresponding defect signal will have reached the last shift-register stage, been amplified by power amplified 34 and caused solenoid valve 36 to open; as a result, pressurized air from source 38 passes through conduit 37 and emerges from ejection nozzle 39 as a blast effecting ejection of the defective cigarette from the conveyor 2.

The defect signal generated at output *c* of comparator 31 is applied, not only to the input *a* of shift register 33 as just described, but also to input *a* of NOT-circuit 43. The defect signal at the output *c* of 31, insofar as the signal transfer circuit 16 is concerned, can be considered a logical "1" signal; accordingly, a signal at output *c* of 31 indicative of the absence of a wrapper defect can be considered a logical "0" signal. It follows that when the wrapper is not defective the signal at the output of NOT-circuit 43 will be a 1, and will be a 0 when the wrapper is defective. Normally, the tested cigarettes will have non-defective wrappers, and accordingly there will normally be applied a 1 signal to input *a* of AND-gate 42. Consequently, the application of synchronizing 1 signals to input *b* of AND-gate 42 by synchronizer 41, in synchronism with the testing of successive cigarettes, will cause sample-and-hold circuit 14 to sample and hold the successive values of the third signal (at output *c* of 13) for the successively tested cigarettes. If the tested cigarettes all have non-defective wrappers, signal transfer circuit 16 will transfer to averaging circuit 17 each successive third signal (from output *c* of 13). However, if a tested cigarette is determined to have a defective wrapper, then as just described the input *a* of AND-gate 42 will receive a 0 signal, as a result of which the synchronizing signals applied to input *b* of AND-gate 42 will not produce sample-signals at output *c* of AND-gate 42. Accordingly, the value of the third signal (at output *c* of 13) associated with the defective cigarette will not be sampled by sample-and-hold circuit 14, and consequently will not be transferred by signal transfer circuit 16 to input *a* of averaging circuit 17. Instead, circuit 14 will simply hold the previously sampled value of the third signal. If a succession of tested cigarettes are determined to have defective wrappers, it follows that none of the corresponding values of the thrid signal (at output *c* of 13) will be transmitted to input *a* of averaging circuit 17.

In this way, all values of the third signal (at output *c* of 13) corresponding to defective cigarettes will be positively excluded from the averaging operation performed by averaging circuit 17.

Fluctuations of the wrapper material porosity during the testing of a long series of cigarettes usually occur only very gradually. Accordingly, assuming that all the filter cigarettes 3 have non-defective wrappers, changes in the electrical first signal furnished by pressure-to-voltage transducer 12 from one non-defective cigarette to the next will be relatively small. Even upon replacement of one wrapper material supply reel by another, in which event the change of wrapper material porosity may be comparatively abrupt, the porosity changes will, in general, nevertheless be less than the change needed to cause the apparatus to interpret the tested cigarette as being defective. Over the long term, the change in wrapper material porosity may actually be in an amount which, if it occurred over the short term, would be interpreted as indicating a cigarette having a defective wrapper. However, as already stated, the component of the total-air-permeability signal attributable to wrapper material porosity changes relatively little from one tested cigarette to the next, so that if the cigarettes have non-defective wrappers the value of the signal applied to input *a* of comparator 31 will not fall lower than the value of the reference signal applied by reference potentiometer 32 to input *b*.

If the wrapper material porosity suddenly decreases, the magnitude of the third signal (at input *b* of comparator 31) will increase correspondingly. Since the generation by comparators 31 of a defect signal requires that the magnitude of the third signal (at input *b* of 31) fall beneath the magnitude of the reference signal (at input *a*), a sudden wrapper material porosity decrease cannot, if the cigarettes are non-defective, result in the generation of a defect signal, in the illustrated exemplary embodiment.

In either event, so long as no defect signal is generated at the output *c* of comparator 31, the synchronizing signals from synchronizer 42 will cause circuit 14 to sample the value of the third signal (at output *c* of 13) and transmit the sampled value to input *a* of averaging circuit 17 for each tested cigarette. The value of the third signal (at output *c* of 13) will be applied by circuit 14 to input *a* of averaging circuit 17 for a time interval equal to the period between successive synchronizing signals from synchronizer 42. The averaging circuit 17 performs its averaging operation relatively slowly, so that its output signal changes only sluggishly in response to the wrapper material porosity changes indicated by the signal applied to its input *a*.

The circuit 20, as already indicated, is operative for generating the second signal (applied to input *b* of 13), indicative of that component of the total air permeability of the tested wrapper attributable to wrapper material porosity. The operation of circuit 20 can be understood most easily if one keeps in mind that, assuming only non-defective cigarettes, the circuit 20 strives, although only sluggishly, to keep the magnitude of the second signal (at input *b* of 13) equal to the magnitude of the first signal (at input *a* of 13).

Let it be assumed that the wrapper material porosity increases. As a result, the magnitude of the first signal (applied to non-inverting input *a* of difference amplifier 13) decreases. Consequently, the third signal (generated at output *c* of 13) will be negative and have a magnitude corresponding to the magnitude of the porosity change. As already indicated, the second signal (at input *b* of 13) strives, but only sluggishly, to follow the first signal (at input *a*). Accordingly if, after the wrapper material porosity decreases, the wrapper porosity remains at the lower value, the thrid signal (at output *c* of 13) will be negative for a number of successive cigarettes, until the magnitude of the second signal (at input *b* of 13) is gradually pulled down towards the lower value. Assuming that the cigarettes in question are not defective, these negative third signals will all be transmitted to input *a* of averaging circuit 17. If the signal applied to input *a* of averaging circuit 17 stays negative for a period of time, the output signal at output *c* of circuit 17 will gradually be pulled negative, for example as the capacitor therein charges towards the negative voltage applied to input *a* of circuit 17.

The signal at output *c* of averaging circuit 17 is applied to both comparators 23, 24. However, if the signal at output *c* is negative, as assumed, then it is only comparator 24 which can be activated. Comparator 24 will in fact become activated when the averaging-circuit output signal falls below the reference signal applied to the lower input of comparator 24 by the illustrated reference potentiometer 27. When comparator 24 is activated, it generates an output signal which, through the intermediary of power amplifier 29, energizes positioning motor 19, causing motor 19 to turn in a direction moving the wiper of potentiometer 21 in a sense decreasing the voltage applied to input *b* of difference amplifier 13. As a result of this decrease, the difference between the first and second signals likewise decreases — i.e., the change in the output signal of difference amplifier 13 attributable to the wrapper material porosity change gradually disappears.

If the wrapper material porosity decreases, then the magnitude of the first signal, applied to input *a* of difference amplifier 13, increases, and the output signal of difference amplifier 13 increases by a corresponding amount and is positive. If the difference-amplifier output signal remains positive over the course of the testing of a plurality of cigarettes, the averaging-circuit output signal will gradually become more and more positive, eventually exceeding the reference voltage supplied by reference potentiometer 26 and thereby activating comparator 23. When activated, comparator 23 generates an output signal which is applied, through the intermediary of power amplifier 28, to the adjusting motor 19, which moves the wiper of potentiometer 21 in a sense increasing the magnitude of the second signal (the voltage at input *b* of 13).

As already indicated, circuit 20 strives, although only sluggishly, to match the second signal (at input *b* of 13) to the first signal (at input *a* of 13), assuming that all the cigarettes being tested are non-defective. A problem could arise with the signals derived from defective cigarettes. For example, if a long series of tested cigarettes all have defective wrappers, and if the third signals (at output *c* of 13) were all involved in the averaging operation performed by averaging circuit 17, then circuit 20 would strive, although only sluggishly, to bring the value of the second signal (at input *b* of 13) to the value of the first signal (at input *a* of 13). The undesirable result of this would be that eventually the value of the second signal (at input *b* of 13) would correspond not only to that component of the air permeability of the wrapper attributable to wrapper material porosity, but instead would additionally correspond to that component of the air permeability attributable to wrapper defects. As a result, the testing arrangement would gradually lose its ability to detect defective wrappers and would eventually accept as non-defective wrappers which were in fact defective. This situation would not remedy itself until there occurred a long series of non-defective cigarettes.

This problem is overcome by providing the blocking means 43. By excluding from the averaging operation performed by averaging circuit 17 all those values of the third signal (at output *c* of 13) corresponding to cigarettes determined to have defective wrappers, one eliminates the possibility of the testing arrangement gradually losing its ability to detect the defectiveness of the tested wrappers.

Instead of generating a signal (the second signal) corresponding to the absolute value of the wrapper material porosity and then reducing the total-air-permeability signal (the first signal) by that amount, the illustrated arrangement could be modified relatively easily — e.g., by changing the various reference values — to make it operative for generating a signal indicative merely of the relative porosity (i.e., the deviation from an average value) and correcting the total-air-permeability signal accordingly. Also, the measuring arrangement is adapted not only for pneumatic testing procedures, but also for analogous procedures, for example knowing testing procedures using sound waves instead of unmodulated pressurized air.

Also, in the illustrated embodiment, the averaging operation is performed upon only those third signals, or alternatively expressed upon those values of the third signal, which corresponds to cigarettes having wrappers which have been determined to be non-defective. However, instead of performing the averaging operation upon the third signals themselves, the averaging operation could be performed upon other signals derived from the first signals.

Clearly, an advantage of the arrangement disclosed herein is that it is possible to determine which articles have wrappers with completely unacceptable defects, independently of variations in the wrapper material porosity from one such article to the next. In the illustrated embodiment, one and the same testing apparatus is employed both for the determination of the wrapper material porosity and for the determination of the presence of wrapper defects; nonetheless, the presence of wrapper defects does not detract from the accuracy of the determination of the wrapper material porosity, and the porosity of the tested wrappers does not detract from the sureness with which the defectiveness or non-defectiveness of the wrapper can be ascertained.

Furthermore, if the testing of articles is interrupted, even for a protracted period, then when the testing is resumed reliable measurement results are obtained immediately. This is because the second signal (the average wrapper material porosity signal) has a duration independent of its manner of generation, e.g., is a persisting signal which is available for compensation purposes immediately upon the resumption of testing. The exemplary arrangement disclosed herein is not only inherently superior to those of the prior art in terms of measurement accuracy; it furthermore avoids the recurrent prior-art problem of the rejection of non-defective articles.

It will be understood that each of the elements described above, or two or more together, may also find a useful application in other types of circuits and constructions differing from the types described above.

While the invention has been illustrated and described as embodied in an apparatus for testing the wrappers of filter cigarettes, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of testing the wrappers of a plurality of cigarettes, cigars, cigarillos, cigarette filters, other rod-shaped smokers' articles, and the like, comprising the steps of generating for each article a first signal indicative of the gas permeability of the wrapper of the article; generating a second signal indicative of the porosity of the material of the wrappers of the articles, processing the first and second signals to form for each article a third signal indicative, to an extent greater than the respective first signal, of the component of the gas permeability of the wrapper of the article not attributable to the porosity of the material of the wrapper; and comparing the third signal to a reference signal to determine whether the wrapper of the tested article is defective, wherein said step of generating said second signal comprises generating said second signal by averaging out the gas permeabilities of the wrappers of a number of such articles.

2. A method as defined in claim 1, wherein said averaging out of the gas permeabilities of the wrappers of a number of such articles comprises averaging out the values of a plurality of signals having values dependent upon the gas permeabilities of the wrappers of a number of such articles.

3. A method as defined in claim 1, wherein said averaging out of the gas permeabilities of the wrappers of a number of such articles comprises averaging out the values of a plurality of signals derived from said first signals and having values dependent upon the gas permeabilities of the wrappers of a number of such articles.

4. A method as defined in claim 1, wherein said averaging out of the gas permeabilities of the wrappers of a number of such articles comprises averaging out the values of the third signals generated for said number of articles.

5. A method as defined in claim 1, wherein the duration of the second signal is independent of its generation.

6. A method as defined in claim 1, wherein the generation of the first signal comprises testing the wrapper of the article by pneumatic means and generating a pneumatic testing signal and then converting the pneumatic testing signal into an electrical signal constituting said first signal.

7. A method as defined in claim 1, wherein said averaging out of the gas permeabilities of the wrappers of a number of such articles comprises averaging out the gas permeabilities only of wrappers already determined to be non-defective.

8. A method as defined in claim 7, wherein said averaging out of the gas permeabilities of the wrappers of a number of such articles comprises averaging out the values of a plurality of signals having values dependent upon the gas permeabilities of the wrappers of a number of such articles.

9. A method as defined in claim 7, wherein said averaging out of the gas permeabilities of the wrappers of a number of such articles comprises averaging out the values of a plurality of signals derived from said first signals and having values dependent upon the gas permeabilities of the wrappers of a number of such articles.

10. A method as defined in claim 9, wherein said averaging out of the values of a plurality of signals derived from said first signals comprises applying each of the plurality of signals derived from said first signals to an averaging circuit subsequent to the comparison of the respective third signal to the reference signal and only if the comparison indicates that the wrapper of the respective article is not defective.

11. A method as defined in claim 7, wherein said averaging out of the gas permeabilities of the wrappers of a number of such articles comprises averaging out the values of the third signals generated for said number of articles.

12. A method as defined in claim 11, wherein said averaging out of the values of the third signals generated for said number of articles comprises applying each of the third signals to an averaging circuit subsequent to the comparison of such third signal to the reference signal and only if the comparison indicates that the wrapper of the respective article is not defective.

13. In an apparatus for testing the wrappers of a plurality of cigarettes, cigars, cigarillos, cigarette filters, other rod-shaped smokers' articles, and the like, in combination, first means for generating for each article a first signal indicative of the gas permeability of the wrapper of the article; second means for generating a second signal indicative of the porosity of the material of the wrappers of the articles by averaging out the gas permeabilities of the wrappers of a number of such articles; third means for processing the first and second signals to form for each article a third signal indicative, to an extent greater than the respective first signal, of the component of the gas permeability of the wrapper of the article not attributable to the porosity of the material of the wrapper; and comparing means operative for comparing the third signal to a reference signal to determine whether the wrapper of the tested article is defective.

14. In an apparatus as defined in claim 13, wherein said second means comprises means operative for averaging out the values of a plurality of signals derived from said first signals and having values dependent upon the gas permeabilities of the wrappers of a number of such articles.

15. In an apparatus as defined in claim 13, wherein said second means comprises means operative for averaging out the values of the third signals generated for said number of articles.

16. In an apparatus as defined in claim 13, wherein said second means comprises means operative for averaging out the gas permeabilities only of wrappers already determined to be non-defective.

17. In an apparatus as defined in claim 16, wherein said second means comprises means operative for averaging out the values of a plurality of signals derived from said frist signals and having values dependent upon the gas permeabilities of the wrappers of a number of such articles.

18. In an apparatus as defined in claim 16, wherein said second means comprises means operative for averaging out the values of the third signals generated for said number of articles.

19. In an apparatus as defined in claim 13, wherein said second means comprises averaging means, signal transfer means for transferring to said averaging means signals derived from the first signals and blocking means connected to said signal transfer means and to said comparing means and operative in response to detection of an article having a defective wrapper for blocking transfer by said transfer means of the respective first signal to said averaging means.

20. In an apparatus as defined in claim 19, wherein said signal transfer means comprises means for transferring the third signals to said averaging means.

21. In an apparatus as defined in claim 19, wherein the outputs of said first and second means are connected to inputs of said third means, and wherein the output of said third means is connected to the input of said comparing means.

22. In an apparatus as defined in claim 19, wherein said first means comprises means for generating a pneumatic signal indicative of the gas permeability of the wrapper of the article and means for converting the pneumatic signal into a corresponding electrical signal constituting said first signal.

23. In an apparatus as defined in claim 19, wherein said signal transfer means comprises a sample-and-hold circuit having an input connected to said third means for receiving third signals and having an output connected to said averaging means for transferring third signals to the latter, and wherein said sample-and-hold circuit has a control input, and further including synchronizing means having an output connected to said control input for controlling the operation of said sample-and-hold circuit in synchronism with the generation of successive third signals for successive articles whose wrappers are being tested.

24. In an apparatus as defined in claim 19, wherein said second means comprises an adjustable signal generator operative for producing a persisting output signal constituting the second signal.

25. In an apparatus as defined in claim 24, wherein said second means further comprises adjusting means connected to said adjustable signal generator for adjusting the latter, and evaluating means having an input connected to the output of said averaging means and having an output connected to said adjusting means and operative for controlling the operation of said adjusting means in dependence upon the output signal of said averaging means.

* * * * *

Notice of Adverse Decision in Interference

In Interference No. 100,795, involving Patent No. 3,991,605, J. Reuland, METHOD AND APPARATUS FOR TESTING THE WRAPPERS OF CIGARETTES AND THE LIKE, final judgement adverse to the patentee was rendered Feb. 24, 1984, as to claims 1 and 13.

[*Official Gazette September 17, 1985.*]